US005712669A

United States Patent [19]

Swanson et al.

[11] Patent Number: 5,712,669

[45] Date of Patent: Jan. 27, 1998

[54] COMMON INK-JET CARTRIDGE PLATFORM FOR DIFFERENT PRINTHEADS

[75] Inventors: David W. Swanson, Escondido; George T. Kaplinsky; Timothy J. Carlin, both of San Diego, all of Calif.

[73] Assignee: Hewlett-Packard Co., Palo Alto, Calif.

[21] Appl. No.: 419,320

[22] Filed: Apr. 10, 1995

Related U.S. Application Data

[63] Continuation of Ser. No. 55,623, Apr. 30, 1993, abandoned.

[51] Int. Cl.[6] ..... B41J 2/175

[52] U.S. Cl. ..... 347/49; 347/87

[58] Field of Search ..... 347/49, 87, 50, 347/40

[56] References Cited

U.S. PATENT DOCUMENTS

| | | | |
|---|---|---|---|
| 4,329,698 | 5/1982 | Smith | 347/87 |
| 4,459,601 | 7/1984 | Howkins | 347/68 |
| 4,611,219 | 9/1986 | Sugitani | 347/43 |
| 4,734,717 | 3/1988 | Rayfield | 347/87 X |
| 4,755,836 | 7/1988 | Ta et al. | 347/49 |
| 4,803,500 | 2/1989 | Milbrandt | 347/50 |
| 4,864,328 | 9/1989 | Fischbeck | 347/43 |
| 4,872,027 | 10/1989 | Buskirk | 347/19 |
| 4,942,408 | 7/1990 | Braun | 347/63 |
| 5,025,271 | 6/1991 | Baker et al. | 347/87 |
| 5,148,194 | 9/1992 | Asai | 347/49 |
| 5,208,610 | 5/1993 | Su | 347/49 |
| 5,363,134 | 11/1994 | Barbehenn | 347/49 |

FOREIGN PATENT DOCUMENTS

| | | | |
|---|---|---|---|
| 0150119 | 7/1985 | European Pat. Off. | B41J 3/04 |

*Primary Examiner*—Joseph W. Hartary

[57] ABSTRACT

A method for designing a second ink-jet cartridge characterized by a datum structure, an ink reservoir system and a printhead structure, given a first cartridge design, wherein the printhead structure of the two cartridges are different. The method uses a common datum structure and ink reservoir system for both the first and second cartridges, to save on development and tooling expenses. The cartridges differ in the shapes or configurations of the headland structures, the flexible interconnect circuits, the nozzle plates, the ink channels or the printhead substrates.

15 Claims, 5 Drawing Sheets

COMMON INK-JET CARTRIDGE PLATFORM FOR DIFFERENT PRINTHEADS

CROSS REFERENCE TO RELATED APPLICATION

This is a continuation of application Ser. No. 08/055,623 filed on Apr. 30, 1993, now abandoned.

BACKGROUND OF THE INVENTION

The present invention relates to ink-jet printers, and more particularly to improvements in a common cartridge platform used for different printheads.

Ink-jet printers are in widespread use today for printing functions in personal computer, facsimile and other applications. Such printers typically include replaceable print cartridges which hold a supply of ink and carry the ink-jet printhead. The cartridge typically is secured into a printer carriage which supports one or a plurality of cartridges above the print medium, and traverses the medium in a direction transverse to the direction of medium travel through the printer. Electrical connections are made to the printhead by flexible wiring circuits attached to the outside of the cartridge. Each printhead includes a number of tiny nozzles defined in a substrate and nozzle plate structure which are selectively fired by electrical signals applied to interconnect pads to eject droplets of ink in a controlled fashion onto the print medium.

In order to achieve accurate printing quality, each removable cartridge includes datum surfaces which engage against corresponding carriage surfaces to precisely locate the cartridge when inserted into the carriage. In this manner, when a cartridge ink supply is exhausted, the cartridge may be replaced with a fresh cartridge, and the printhead of the new cartridge will be precisely located relative to the carriage.

As improvements have been made in the printhead design or in the ink delivery system for cartridges, it has been the common design practice to design entirely new printer cartridges, incurring expenses in the design and tooling for the new cartridges. Thus, if a new printhead is developed which has different physical size parameters from an earlier design of a printhead, advancing for the sake of example, from a 180 dpi to a 300 dpi resolution, the common practice has been to develop an entirely new cartridge platform to support the new printhead, including different datum surfaces, and indeed, requiring a new printer carriage to support the cartridge.

It is known, in a one-cartridge printer application, to change the nozzle firing frequency, along with the width of the ink feed slots in the substrate die, without changing the datum structure or ink delivery system in an ink-jet cartridge, to achieve improved printing performance.

In a series of printers marketed by Hewlett-Packard Company, the "Deskjet" series, two different cartridges are available for use in the same printer, one having a relatively lower ink capacity than the other. In this case, the high and low ink capacity cartridges employ the same datum structure, but different ink delivery systems.

In one instance, even though the shape and configuration of the nozzle plate and substrate have not been changed, the size of nozzle plate orifices and substrate firing resistors have been changed, to adapt a particular ink-jet cartridge design to a new ink of different viscosity. In another instance, an existing cartridge designed for black ink was modified to operate with color ink, by changing the nozzle orifice size and substrate firing resistor size, reducing the number of active nozzles, and making slight dimensional variations to the substrate die and nozzle plate, in order to adapt the printhead to different fluidic properties of another ink, while using the same datum structure and ink reservoir system.

Commonly assigned U.S. Pat. No. 4,872,027 describes an ink-jet printer having identifiable interchangeable printheads which are interchangeably attachable to the printer carriage. The heads are provided with individual codes read by the printer control system to reconfigure its control functions to suit the control requirements of the identified head.

It is therefore an object of this invention to provide a method for designing a cartridge which incorporates a common datum structure and ink delivery system from another cartridge design to support a different printhead with different printing characteristics, thereby allowing the development expenses and tooling costs for the common structure to be spread over more than one cartridge.

A further object is to provide a family of ink cartridges, each of which employs a common datum structure and common ink reservoir system but with physically different printheads.

SUMMARY OF THE INVENTION

This invention in a general sense is a method for constructing an ink cartridge for an ink-jet printer, employing common structure from another ink cartridge to realize a savings in development and manufacturing expenses. The method includes the step of selecting a first preexisting cartridge design for an ink-jet cartridge, the first design characterized by a first datum structure, a first ink reservoir system, and a first printhead structure. The printhead structure includes the ink channel leading from the ink reservoir system, the headland structure, the printhead substrate and nozzle plate, and the electrical interconnection circuit for providing control signals to the substrate. The method further includes the step of utilizing the first datum structure and the first ink delivery system in a second ink cartridge design also characterized by a second printhead structure, wherein the first and second cartridge designs share common datum structures and common ink delivery systems. A new printhead structure is provided for the second cartridge which is physically different in shape or configuration than the printhead structure for the first cartridge. In a preferred application, the new printhead structure is designed to provide a printing resolution which is greater than the printing resolution provided by the first ink cartridge. The particular changes which can be made to the printhead structure to increase the resolution include decreasing the spacing between nozzles and increasing the number of active nozzles; these changes generally, but not necessarily, include a change in the size of the substrate die.

The invention further is characterized by a family of ink cartridges for ink-jet printers having a common platform. The family includes a first ink cartridge, comprising a first registration datum structure for registering the position of the first ink cartridge in a printer carriage, a first ink reservoir system and a first printhead structure. A second ink cartridge includes a second registration datum structure for registering the position of the cartridge in a printer carriage, a second ink reservoir system and a second printhead structure. The first and second datum registration structures and the first and second ink reservoir systems are substantially identical. The second printhead structure is physically different in shape or configuration from the first printhead structure.

As a result of the new method and cartridge system, significant savings in development and manufacturing costs can be achieved, and the time necessary to bring a new cartridge to the market with different print characteristics can be substantially reduced.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
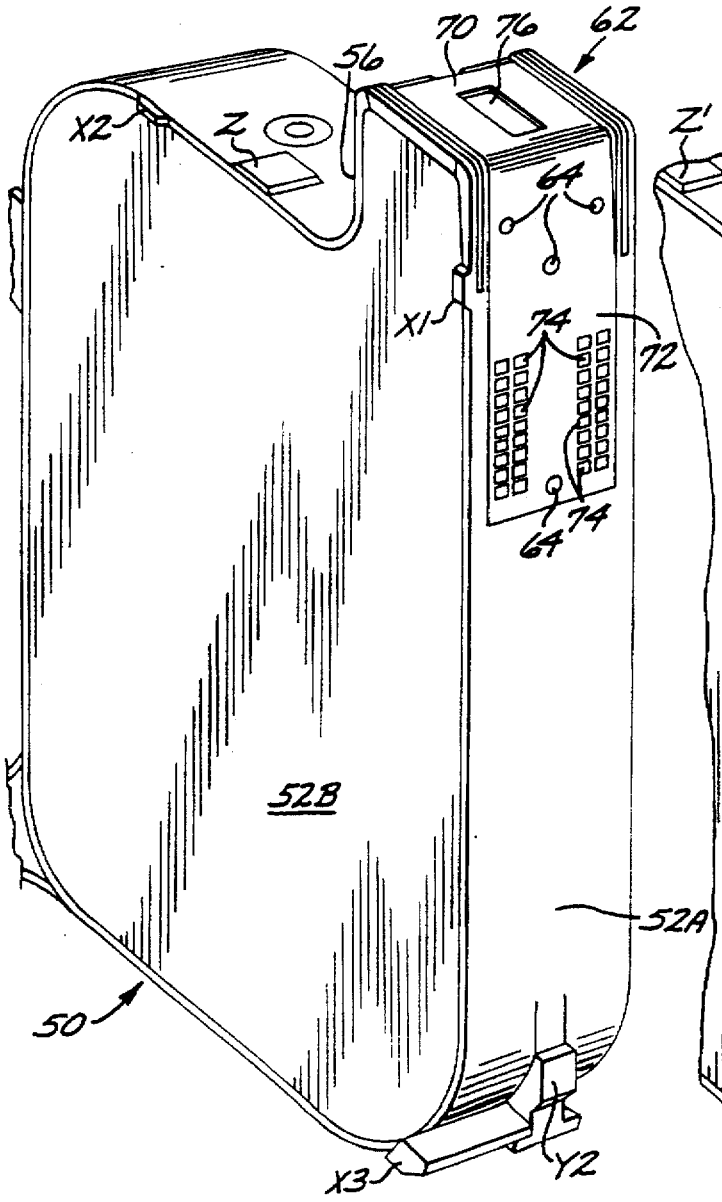
FIG. 1 is an isometric view of a first ink-jet cartridge employing a given datum structure and ink delivery system with a first printhead structure.

FIG. 1 illustrates in isometric view a first ink-jet cartridge 50, which generally includes a housing 52 which houses an ink delivery system including an ink reservoir (not shown). An ink delivery system suitable for the cartridge 50 is described in co-pending, commonly assigned applications "Collapsible Ink Reservoir Structure and Printer Ink Cartridge," Ser. No. 07/929,615, filed Aug. 12, 1992, by George T. Kaplinsky; and "Ink Pressure Regulator for a Thermal Ink-Jet Printer," Ser. No. 07/928,811, filed Aug. 12, 1992, by Tofigh Khodapanah et al. The entire contents of both applications are incorporated herein by this reference.

Figure 10B:
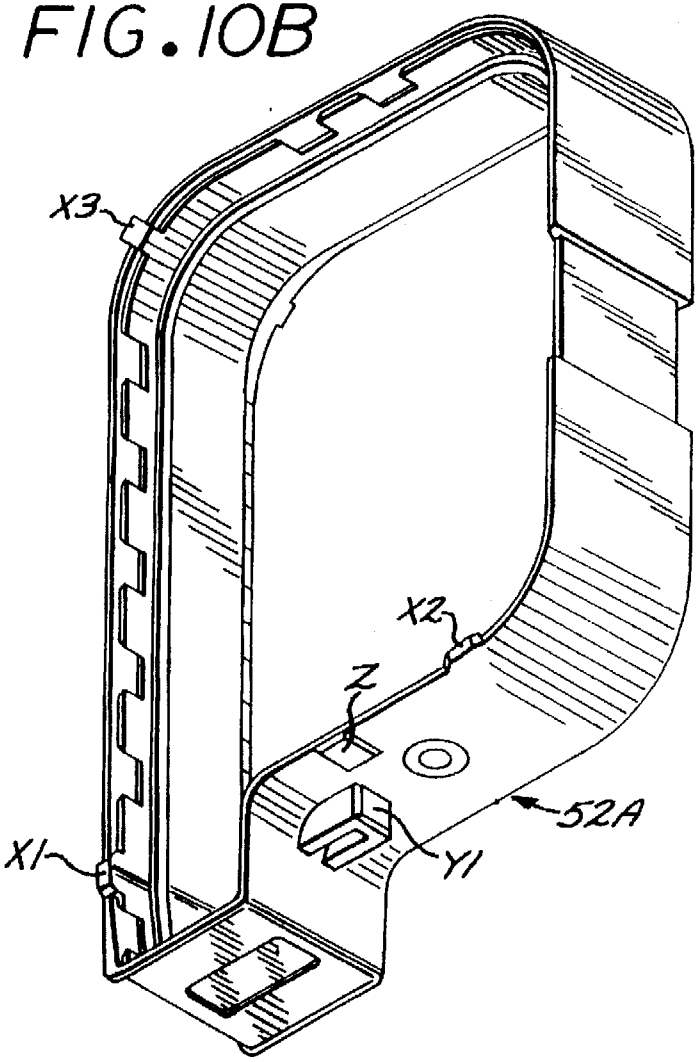
FIGS. 10A and 10B are isometric views of a cartridge peripheral housing structure member illustrating an exemplary embodiment of datum structures for a cartridge.
Figure 10A:
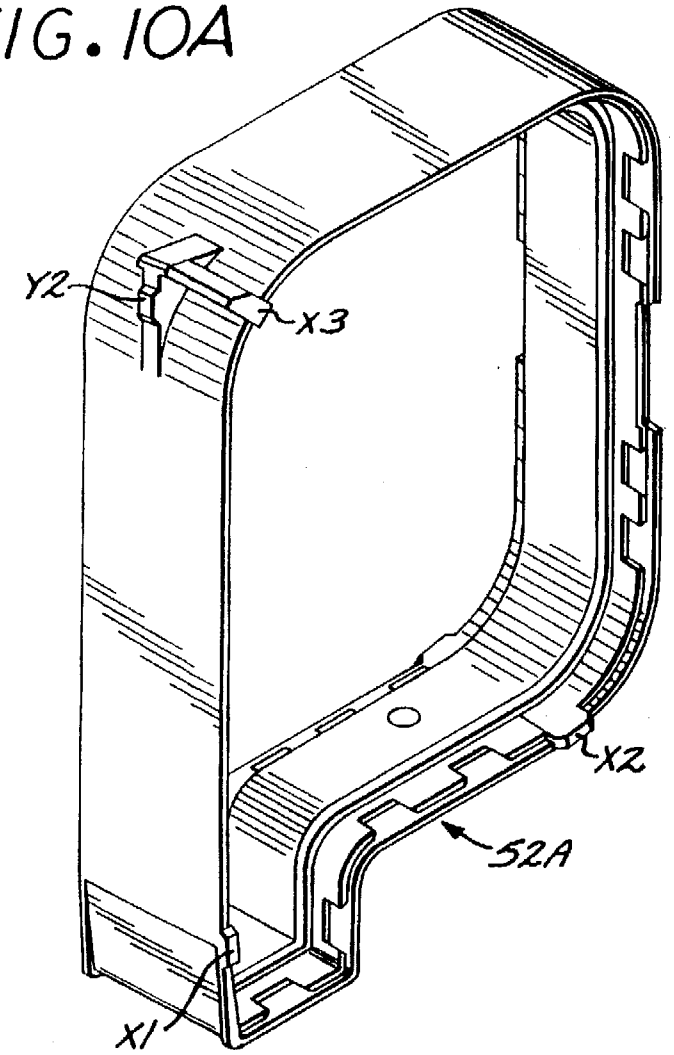

The housing structure 52 in this embodiment comprises a peripheral housing structure 52A, fabricated of a molded engineering plastic. Metal cover plates 52B are assembled to the structure 52A to complete the housing enclosure, as more particularly described in commonly assigned "Thermal Ink-Jet Pen with a Plastic/Metal Attachment for the Cover," Ser. No. 07/994,810, filed Dec. 22, 1992, by D. Timm, Jr. et al., the entire contents of which are incorporated herein by this reference. The housing structure 52 defines a number of datum surfaces, used to precisely position the cartridge 50 within a printer carriage. The structure 52 is shown in isolation in the isometric view of FIGS. 10A and 10B. As shown therein, the structure 52 includes three X axis datum structures X1, X2 and X3, two Y axis datum structures Y1 and Y2, and one Z axis datum structure. A cartridge employing this datum structure is described in commonly assigned application, "Side Biased Pen Datum Scheme for Thermal Ink-Jet Cartridge," Ser. No. 08/057,241, filed Apr. 30, 1993, by D. Swanson et al., the entire contents of which are incorporated herein by this reference. The datum structures typically abut against corresponding datum structures defined on the printer carriage when the cartridge is pushed into place in the carriage.

Figure 9:
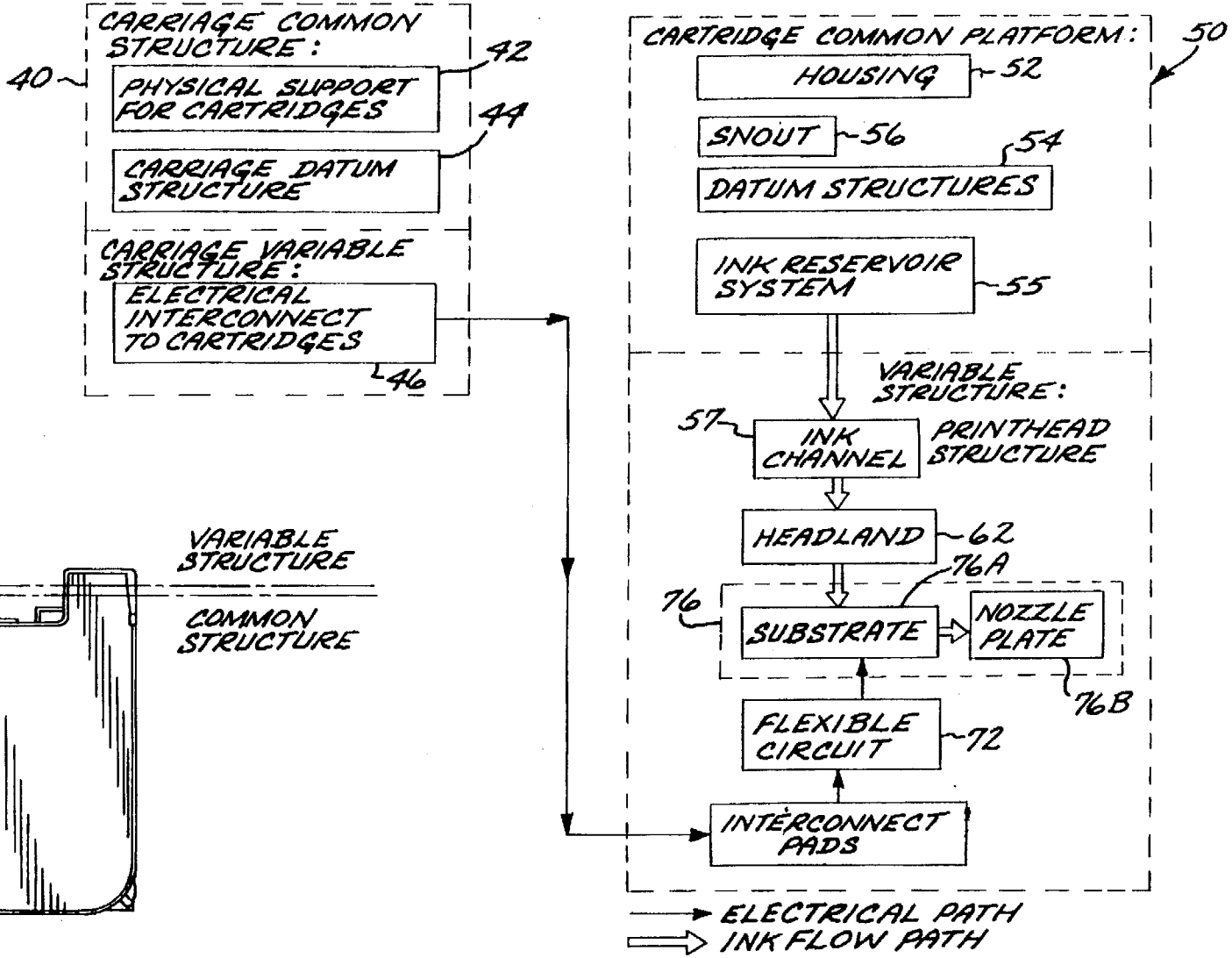
FIG. 9 is a schematic diagram illustrating the common and variable structure in a family of cartridges embodying this invention.

The cartridge 50 further comprises a protruding snout region 56, and a headland region 62 extending at the snout end on which the cartridge ink-jet printhead 70 is mounted. The datum structures for the cartridge are located away from the headland structure, permitting variations to the headland structures without requiring modifications to any datum structures. A printhead 70 includes a thin flexible interconnection circuit carrier 72 which carries a plurality of electrical interconnection pads 74 which make electrical contact with corresponding pads defined in the print carriage socket for the cartridge, when the cartridge is installed in the socket. The pads 74 are connected via wiring traces defined in or on the circuit 72 with active ink-jet firing elements comprising the assembly indicated generally as assembly 76 in FIG. 1. A printhead substrate 76A and a nozzle plate 76B, schematically illustrated in FIG. 9, are secured together to comprise the assembly 76. The substrate/nozzle plate assembly 76 is attached with the flexible carrier 72. In this cartridge embodiment, the carrier 72 wraps around the headland region, and is aligned in position during assembly relative to the datum structure by use of holes 64. Flexible carriers are attached directly to the headland and housing structure by thermal bonding, by the addition of bonding materials, such as hot melts and thermal plastic films, or by thermal and UV-set epoxies.

As shown in FIG. 9, a fluid connection is made to the substrate 76A from the ink reservoir system 55 comprising the cartridge 50, as the flexible circuit carrier 72 is secured in position to the headland structure. This provides a means for delivering ink through the ink channel 57 from the reservoir 55 to the substrate/nozzle plate assembly 76 and to tiny ink-jet nozzles formed in the nozzle plate 76B. By selectively activating the active printhead elements, as is well known in the art, tiny ink-droplets can be expelled through the nozzles to print onto the medium.

Figure 2:
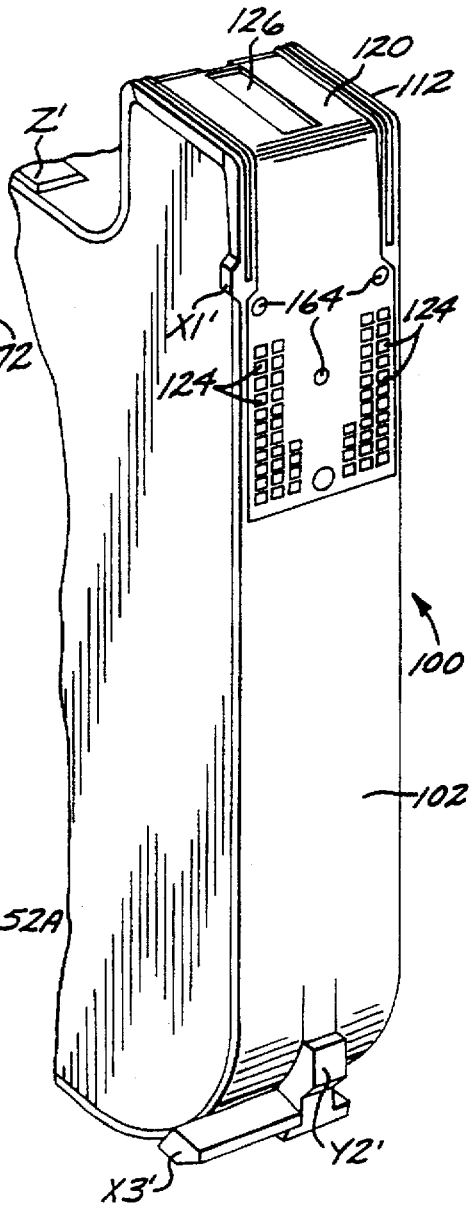
FIG. 2 is a partial, broken-away isometric view of a second ink-jet cartridge employing the same datum structure and ink delivery system as in the cartridge of FIG. 1, but with a different printhead configuration.

FIG. 2 is a partial isometric view of a second ink-jet cartridge 100, which includes a housing structure 102 which is identical to the housing 52 of cartridge 50, with identical datum structures defined therein. For example, datum structure X1' of cartridge 100 is identical to datum structure X1 of cartridge 50, datum structure X3' is identical to datum structure X3, and so on. The ink reservoir system for the cartridge 100 is identical to that of cartridge 50. The features of cartridge 100 which may differ from corresponding features of cartridge 50 are the ink channel 117 (FIG. 4) and the printhead structure.

In comparison to the pattern of electrical interconnection pads 74 of the flexible carrier 70, the pattern of pads 124 of the flexible carrier 120 shown in FIG. 2 has a greater number of pads, i.e., an additional two shortened rows of pads. This permits a greater number of nozzles comprising the nozzle plate portion 126 to be controlled. For example, the printhead of cartridge 50 may include a nozzle pattern for producing a 300 dot per inch print resolution, and the printhead of cartridge 100 may include a nozzle pattern for producing a 600 dot per inch print resolution. The number of nozzles defined in the nozzle plate assembly 126 is greater than the number of nozzles defined in the plate 76, and the nozzle plate spacing is different. Moreover, it will be seen that the area of the substrate/nozzle plate assembly 126 comprising the printhead structure of cartridge 100 is somewhat larger than the area of the substrate/nozzle plate assembly 76 comprising the cartridge 50.

Figure 3:
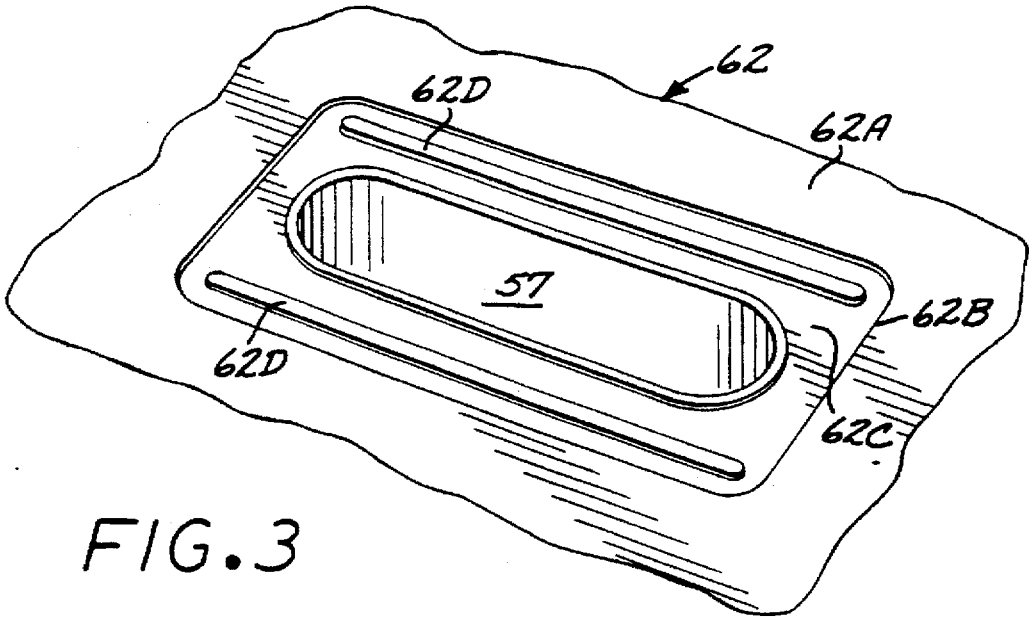
FIG. 3 illustrates the headland structure of the cartridge of FIG. 1.
Figure 4:
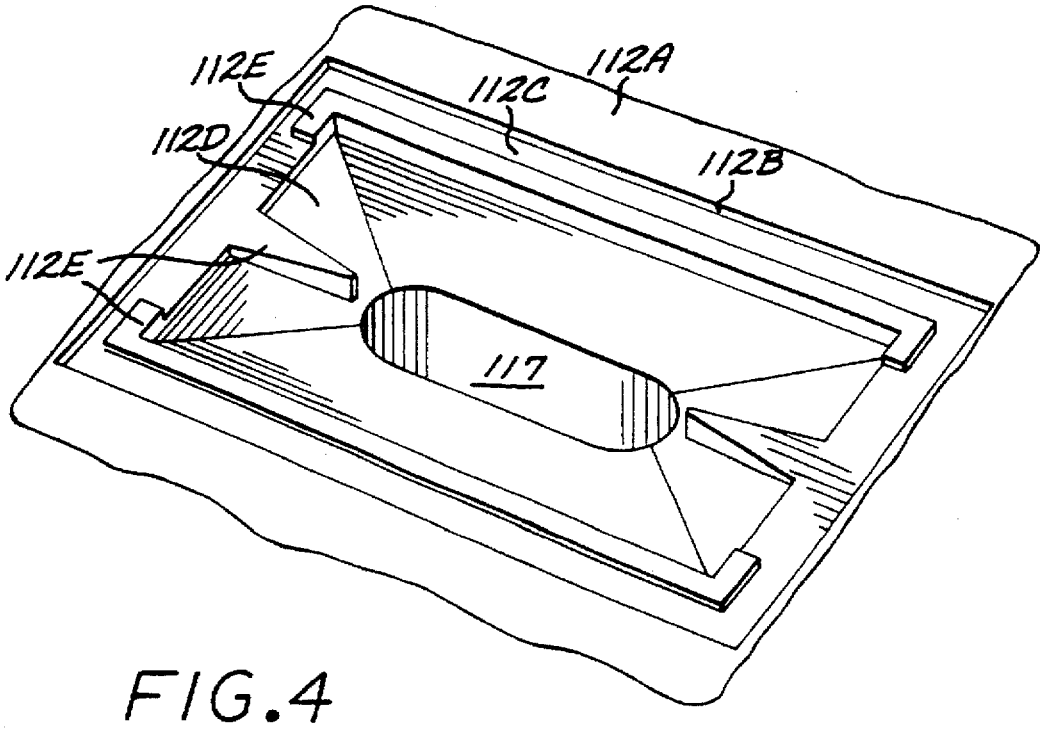
FIG. 4 illustrates the headland structure of the cartridge of FIG. 2.

The headland surfaces supporting the respective assemblies 76 and 126 of the two cartridges 50 and 100 are shown in FIGS. 3 and 4, respectively. In FIG. 3, the headland region 62 comprises a flat peripheral surface area 62A, a recessed flat area 62C bounded by a generally rectilinear border 62B, and a pair of rib protrusions 62D extending upwardly from the recessed area 62C. A channel opening 57 provides communication between the printhead substrate/nozzle plate assembly 76 and the ink reservoir system 55. The printhead 70 is secured over the recessed region 62C, and edges of the printhead are bonded all around the peripheral region 62A to provide a leakproof seal of the printhead to the headland region 62.

In FIG. 4, the headland region 112 of the cartridge 100 includes a generally flat peripheral region 112A, surrounding a rectilinear recessed region 112C, bounded by a border 112B. Rib members 112E extend upwardly from the recessed area 112C to support the printhead 120. A tapered region 112D tapers down to the ink channel 117. The region 112C of the cartridge 100 is somewhat larger in area than the region 62C of cartridge 50. The assembly 126 in this example is somewhat larger in area than the assembly 76 of FIG. 1, and includes a somewhat larger number of nozzles, thereby also requiring a greater number of interconnect pads 114 to provide control of the operation of the nozzles.

Figure 5:
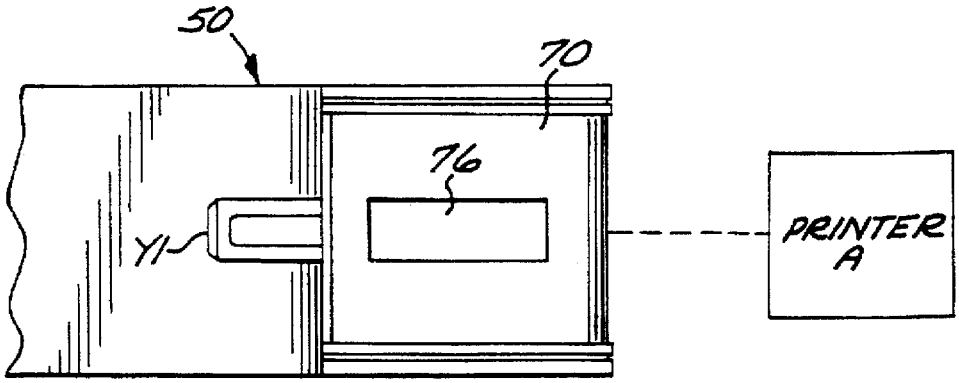
FIGS. 5 and 6 are end views showing a simplified nozzle plate attached to the structure of the snout regions of the cartridges of FIGS. 1 and 2.
Figure 6:
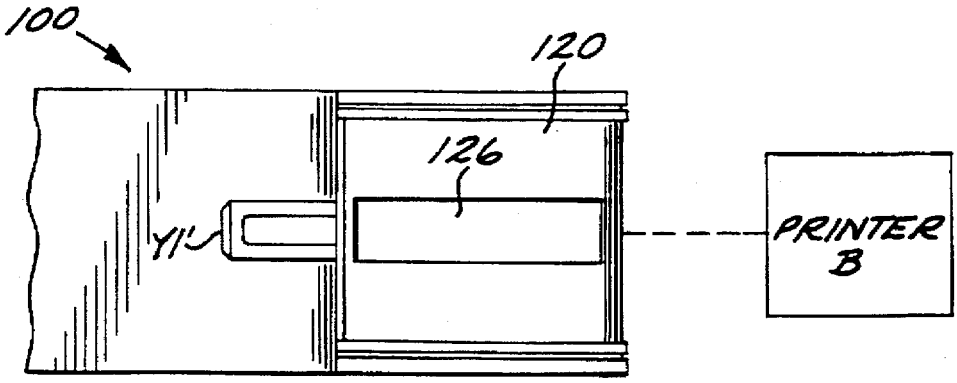

FIGS. 5 and 6 are end views showing a simplified substrate/nozzle plate assembly of the cartridges 50 and 100 of FIGS. 1 and 2, respectively. Corresponding identical datum structures Y1 and Y1' and 118 are shown in these top views, further illustrating the commonality of the cartridge structure. The printheads 76 and 126 are shown assembled to the respective headland regions. The somewhat longer length of the nozzle assembly 126 in comparison to nozzle assembly 76 is evident from FIGS. 5 and 6.

Figure 7:
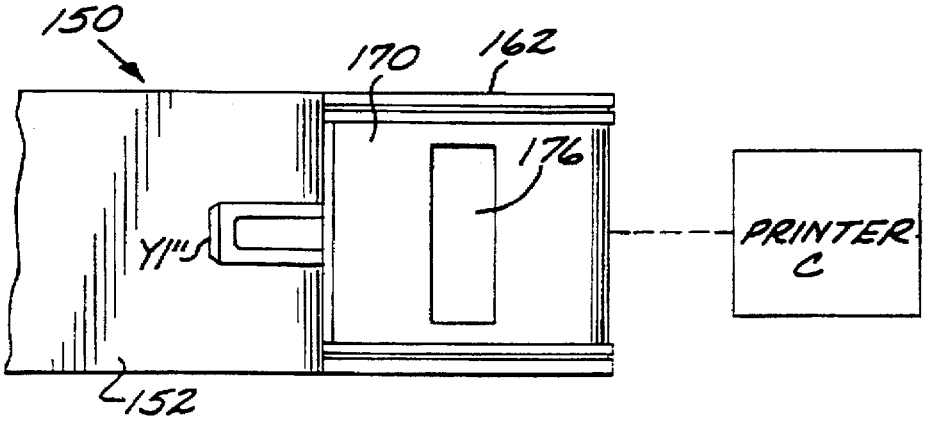
FIG. 7 is an end view of the snout region of a third cartridge employing the same datum structure and ink delivery system of the cartridges of FIGS. 1 and 2, but with yet another printhead configuration.

FIG. 7 shows a third example of a cartridge employing a common platform with cartridge 50 of FIG. 1. The housing 152 is identical with housing 50 of FIG. 1, and employs identical datum structures as those structures comprising housing 50; e.g., datum structure Y1" is identical to structure Y1. Moreover, the cartridge 150 employs the same ink reservoir system employed in the cartridge 50. Only the headland region 162 and printhead 170 are changed from the corresponding elements 62 and 70. In this embodiment, the nozzle assembly 176 is rotated 90 degrees relative to the orientation of the nozzle assembly 76 in FIG. 1, e.g., to provide a low profile printer. In other applications, the nozzle assembly 176 could be oriented at an angle other than 90 degrees.

The three ink-jet cartridges 50, 100 and 150 are configured to be used with three different printers A, B and C as shown in FIGS. 5, 6 and 7. In a typical application where the cartridges 50, 100 and 150 have physically different electrical connections, the printers will require different carriage electrical connection circuitry to provide the necessary control signals to the different cartridges 50, 100 and 150.

Figure 8:
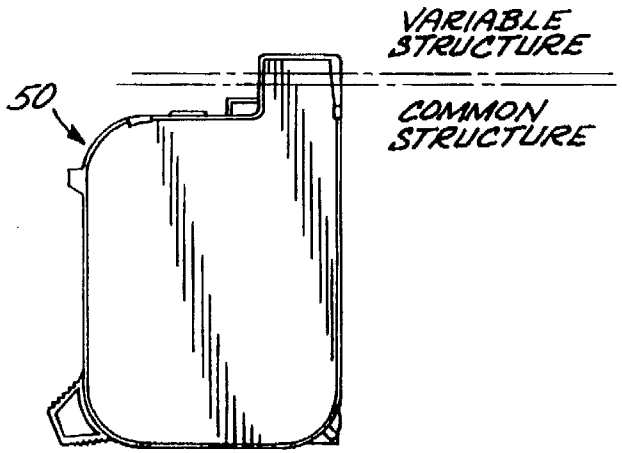
FIG. 8 is a plan view of an ink-jet cartridge as in FIG. 1, showing the common structure of the cartridges of FIGS. 1, 2 and 3, and the printhead headland structure area which is not common to the three cartridges.

FIG. 8 is a side view of the cartridge 50 of FIG. 1, showing the structure which is unchanged in the design of the cartridges 100 and 150. In the three cartridges 50, 100 and 150, the cartridges share the same ink reservoir system design, the same snout, and the same datum structure design. Only the structure of the headland and the print-head has been changed. The commonality of design elements between the three types of cartridges provides savings in development costs and time, and in manufacturing costs as well. Thus, the three cartridges 50, 100 and 150 comprise a family of ink-jet cartridges which share a common cartridge platform, but which have printhead structures which are physically different in shape or configuration to achieve different printing characteristics.

FIG. 9 is a schematic block diagram illustrating in a functional sense the cartridge 50 of FIG. 1 and an exemplary printer carriage 40. The cartridge 50 is secured within the carriage by a physical support structure 42 comprising the carriage 40. The carriage also includes carriage datum structures 44 which interact with the housing 52 or datum structures of the cartridge 50, to precisely register the position of the cartridge within the carriage. The carriage further includes electrical interconnection circuit 46 to make electrical contact with the flexible interconnect circuit 72 of the cartridge 50. This electrical interconnection circuitry is a variable structure, in that its design will be varied, depending on the cartridge interconnection circuitry configuration.

Still referring to FIG. 9, the common platform comprising the cartridge 50 includes the housing structure 52, the datum structure X1, X2, X3, Y1, Y2 and Z, and the ink reservoir system 55. The variable structure of the cartridge 50, which can be modified in shape or configuration in accordance with the invention to produce new cartridges with different or improved printing characteristics, is the printhead structure, which comprises the headland 62, the substrate 76A, nozzle plate 76B and the flexible interconnect circuit 72. One or all of the variable features may be physically changed in shape or configuration in accordance with the invention to achieve a desired change or improvement in the printing characteristics of the cartridge. A preferred printing characteristic which is improved is the printing resolution, achieved e.g., by decreasing the spacing between nozzles and increasing the number of active nozzles.

In accordance with one aspect of the invention, an ink cartridge for an ink-jet printer can be designed, based in part on the common structure design of another cartridge. The method includes the following steps:

selecting a first cartridge design characterized by a first datum structure, a first ink reservoir system, and a first printhead structure;

utilizing the first datum structure and the first ink reservoir system in a second ink cartridge design also characterized by a second printhead structure, wherein the first and second cartridge designs share common datum structures and common ink reservoir systems, and wherein the second printhead structure is physically different in shape or configuration from the first printhead structure; and constructing a second ink cartridge in accordance with the second cartridge design, the ink cartridge characterized by a datum structure and ink reservoir structure virtually identical to the first datum structure and first ink reservoir system, and wherein the second printhead structure is physically different in shape or configuration from the first printhead structure.

The invention allows the investment in research and development and manufacturing of the common platform to be leveraged into different sectors of the ink-jet printing market. The common ink delivery system also lowers the engineering and manufacturing support costs as compared with the conventional one-printhead, one-ink-delivery-system type of design heretofore employed in the design and manufacturing of cartridges. For example, the invention permits the savings of time to design and build a manufacturing line to construct the cartridges; indeed the same line may in some cases be used to build different cartridges designed in accordance with the invention. Since the same or similar production equipment for a given cartridge production line can be used to produce another cartridge in the same family, the equipment can typically be acquired in a shorter time and for less cost than if an entirely new line were designed and set up.

It is understood that the above-described embodiments are merely illustrative of the possible specific embodiments which may represent principles of the present invention. The invention is not limited to specific disclosed embodiments of headland structures, substrate or nozzle plate configurations, interconnect circuits, datum structures, ink delivery systems, or the like. Other arrangements may readily be devised in accordance with these principles by those skilled in the art without departing from the scope and spirit of the invention.

What is claimed is:

1. A family of ink-jet printer cartridges which employ common structural features to minimize retooling costs and the like, the family comprising:

a first ink cartridge, comprising a first housing structure defining a first set of registration datum structures for registering the position of said first ink cartridge in a printer carriage in relation to X, Y and Z reference axes, a first printhead structure comprising a first headland structure and a first nozzle assembly comprising a first array of nozzles from which ink droplets are emitted during printing operations, a first ink reservoir system for delivering ink to said printhead structure, and a first supply of liquid ink in the ink reservoir system, wherein each of said nozzles of said first array are fed with ink from said first ink reservoir system; and a second ink cartridge, comprising a second housing structure defining a second set of registration datum structures for registering the position of said second ink cartridge in a printer carriage in relation to X, Y and Z reference axes, a second printhead structure comprising a second headland structure and a second nozzle assembly comprising a second array of nozzles from which ink droplets are emitted during printing operations, a second ink reservoir system for delivering ink to said second printhead structure, and a second supply of liquid ink within said second ink reservoir system, wherein each of said nozzles of said second array are fed with ink from said second ink reservoir system, wherein said first and second housing structures are substantially identical to each other, said first and second registration datum structures are substantially identical to each other, said first and second ink reservoir systems are substantially identical to each other, and said second printhead structure is physically different in a shape or configuration from a corresponding shape or configuration of said first printhead structure so as to provide an improved printing resolution characteristic of said second ink cartridge in relation to a printing resolution characteristic of said first ink cartridge, and wherein the second nozzle assembly is longer than said first nozzle assembly to provide a different printing swath width for the second cartridge than a corresponding printing swath width for the first cartridge.

2. The cartridge family of claim 1 wherein said first headland structure is physically different in its shape or configuration from a corresponding shape or configuration of said second headland structure.

3. The cartridge family of claim 1 wherein said first and second nozzle assemblies respectively comprise first and second substrate nozzle plates each including a pattern of nozzles from which said ink droplets are emitted, and wherein said first nozzle plate is physically different from said second nozzle plate.

4. The cartridge family of claim 3 wherein said first nozzle plate includes a first nozzle pattern for producing a first print resolution, and said second nozzle plate includes a second nozzle pattern for producing a second nozzle resolution which is greater than said first resolution.

5. The cartridge family of claim 1 wherein said first and second printhead structures respectively further comprise first and second flexible interconnection circuits, and wherein said first interconnection circuit is physically different in a shape or configuration from a corresponding shape or configuration of said second interconnection circuit.

6. The cartridge family of claim 1 wherein said first cartridge is adapted for use with a first printer having a first carriage, and said second cartridge is adapted for use with a second printer having a second carriage, and wherein said second carriage is physically different in a shape or configuration from a corresponding shape or configuration of said first carriage.

7. The cartridge family of claim 6 wherein said first carriage includes first interconnection means for accepting and making electrical contact with said first ink cartridge, and said second carriage includes second interconnection means for accepting and making electrical contact with said second cartridge, said second interconnection means being physically different from said first interconnection means.

8. The cartridge family of claim 1 wherein said first set of registration datum structures comprises a plurality of first X axis datum structures for registering said position of said first cartridge in relation to an X axis, and a plurality of first Y axis datum structures for registering said position of said first cartridge in relation to a Y axis, said second set of registration datum structures includes a plurality of second X axis datum structures for registering said position of said second cartridge in relation to said X axis, and a plurality of second Y axis datum structures for registering said position of said second cartridge in relation to said Y axis, and wherein corresponding ones of said first and second X axis datum structures are identical, and corresponding ones of said first and second Y axis datum structures are identical.

9. A modular construction method for constructing a family of ink cartridges for an ink-jet printer, said family employing a common cartridge platform structure, said method comprising the following steps:

providing a first ink cartridge, said first cartridge including said common platform structure, said common structure including a cartridge housing structure, position registration datum structures for registering a position of said cartridge in a printer carriage in relation to X, Y and Z reference axes and an ink reservoir system contained within the cartridge housing structure, said first cartridge further including first variable cartridge structure specific to said first cartridge, said variable structure including a first printhead structure comprising a first headland structure, a first nozzle plate assembly comprising a first nozzle array, and a first flexible interconnection circuit for making electrical connection to said first nozzle plate assembly to energize active elements therein during printing operations so that ink droplets are emitted from said nozzles of said nozzle array, each of said nozzles being fed from said first ink reservoir system; and providing a second ink cartridge employing said common platform structure, said common platform structure including a cartridge housing structure, position registration datum structures for registering position of said cartridge in a printer carriage in relation to X, Y and Z reference axes and an ink reservoir system contained within a cartridge housing, said second cartridge further including second variable cartridge structure specific to said second cartridge, said second variable structure including a second printhead structure comprising a second headland structure, a second nozzle plate assembly comprising a second nozzle array, and a second flexible interconnection to said second nozzle plate assembly to energize active elements therein during printing operations to emit ink droplets, each of said nozzles of said second array being fed from said second ink reservoir system, wherein said cartridge housing structures for said first and second cartridges are virtually identical to each other, said datum structures for said first and second cartridges are virtually identical to each other, said ink reservoir systems for said first and second cartridges are virtually identical to each other, and said first and second printhead structures are physically different from each other, said second printhead structure for said second cartridge having an increased printing resolution characteristic in relation to a printing resolution characteristic of said first cartridge, and the nozzle assembly of the second cartridge is longer than the nozzle assembly of the first cartridge to provide a different printing swath width, wherein said use of said common platform structure in said first and second cartridges leads to overall savings in development and manufacturing expenses for said first and second cartridges.

10. The method of claim 9 wherein said first and second printhead structures respectively comprise first and second nozzle plates, and wherein said second nozzle plate is oriented orthogonally at said second printhead structure in relation to an orientation of said first nozzle plate at said first printhead structure.

11. The method of claim 9 wherein said second nozzle plate is oriented at an offset angle relative to an orientation of said first nozzle plate.

12. The method of claim 9 wherein said first and second printhead structures respectively comprise first and second ink channels, and said second ink channel is physically different in a shape or configuration from a corresponding shape or configuration of said first ink channel.

13. The method of claim 9 further comprising the steps of:

filling said first ink reservoir with a first quantity of liquid ink; and filling said second ink reservoir with a second quantity of liquid ink.

14. A family of ink-jet printer cartridges which employs common structural features to minimize retooling costs and the like, the family comprising:

a first ink cartridge, comprising a first set of registration datum structures for registering the position of said first ink cartridge in a printer carriage in relation to X, Y and Z reference axes, a first printhead structure comprising a first headland structure and a first nozzle assembly comprising a first array of nozzles from which ink droplets are emitted during printing operations, a first ink reservoir system for delivering ink to said printhead structure, wherein each of said nozzles of said first array are fed with ink from said first ink reservoir system, an external first rectilinear housing structure for carrying said first set of registration datum structures and enclosing said first reservoir system, and a first snout region protruding from said first housing structure, said first headland region defined in said first snout region; and a second ink cartridge, comprising a second set of registration datum structures for registering the position of said second ink cartridge in a printer carriage in relation to X, Y and Z reference axes, a second printhead structure comprising a second headland structure and a second nozzle assembly comprising a second array of nozzles from which ink droplets are emitted during printing operations, a second ink reservoir system for delivering ink to said second printhead structure, wherein each of said nozzles of said second array are fed with ink from said second ink reservoir system, an external second rectilinear housing structure for carrying said second set of registration datum structures and enclosing said second reservoir system, and a second snout region protruding from said second housing structure, said second headland region defined in said second snout region, wherein said first rectilinear housing structure is virtually identical to said second rectilinear housing structure in shape and configuration, said first snout region is virtually identical in its shape and configuration to a corresponding shape and configuration of said second snout region, said first and second registration datum structures are virtually identical to each other, said first and second ink reservoir systems are virtually identical to each other, and said second printhead structure is physically different in a shape or configuration from a corresponding shape or configuration of said first printhead structure so as to provide an improved printing resolution characteristic of said second ink cartridge in relation to a printing resolution characteristic of said first ink cartridge, said second nozzle assembly is longer than said first nozzle assembly to provide a different printing swath width for the second ink cartridge than a printing swath width for the first ink cartridge, and wherein said first set of datum structures is located well away from said first printhead structure, and said second set of datum structures is located well away from said second printhead structure, permitting modifications to said printhead structures to provide another cartridge in said cartridge family without requiring corresponding modifications to any of said datum structures.

15. The cartridge family of claim 14 further comprising a first quantity of ink disposed in said first ink reservoir and a second quantity of ink disposed in said second ink reservoir.

* * * * *

UNITED STATES PATENT AND TRADEMARK OFFICE

CERTIFICATE OF CORRECTION

PATENT NO : 5,712,669

DATED : January 27, 1998

INVENTOR(S) : Swanson et al.

It is certified that error appears in the above-identified patent and that said Letters Patent is hereby corrected as shown below:

At Column 9, line 7, delete "for registering position of said" and insert in lieu thereof --for registering a position of said--.

At Column 9, line 16, after "a second flexible interconnection" and before "to said second nozzle" insert --circuit for making electrical connection--.

Signed and Sealed this

Fifth Day of May, 1998

Bruce Lehman

*Attest:*

BRUCE LEHMAN

*Attesting Officer*

*Commissioner of Patents and Trademarks*